US007162907B2

(12) United States Patent
Joseph et al.

(10) Patent No.: US 7,162,907 B2
(45) Date of Patent: Jan. 16, 2007

(54) PUNCH TOOL FOR ANGLED ORIFICE

(75) Inventors: J. Michael Joseph, Newport News, VA (US); Sam Gruber, Natrona Heights, PA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/807,339

(22) Filed: Mar. 24, 2004

(65) Prior Publication Data

US 2005/0210949 A1 Sep. 29, 2005

(51) Int. Cl.
*B21D 28/26* (2006.01)
*B21D 28/34* (2006.01)

(52) U.S. Cl. ..... 72/334; 72/325; 29/890.142; 83/689

(58) Field of Classification Search ..... 72/325, 72/334, 335, 479; 29/890.142, 890.143, 29/896.6; 83/696, 52, 55, 689
See application file for complete search history.

(56) References Cited

U.S. PATENT DOCUMENTS 1,801,153 A 11/1928 Gray
1,801,453 A 4/1931 Patterson
2,180,545 A * 11/1939 Parsons et al. ..... 72/327
2,846,901 A 8/1958 Baule
2,846,902 A 8/1958 Cowley
3,656,379 A 4/1972 Clark
3,656,394 A * 4/1972 McCutcheon ..... 83/689
3,678,941 A 7/1972 Dixon
4,012,975 A 3/1977 LaLone
4,739,687 A 4/1988 Wanner et al.
4,771,663 A 9/1988 Naito et al.
6,009,787 A 1/2000 Hanggi
6,109,086 A 8/2000 Gambrel et al.
6,678,955 B1 1/2004 Takeshita et al.

FOREIGN PATENT DOCUMENTS

EP PCT/US2005/004339 3/2004
JP 63224820 9/1988
JP 05293557 11/1993
SU 863202 9/1981

* cited by examiner

*Primary Examiner*—Daniel C. Crane

(57) ABSTRACT

A punch tool for punching orifice that has wall surfaces extending at an angle relative to a generally planar surface of a workpiece. The punch tool of the preferred embodiments is provided with configurations that, at the very least, increase the life of the tool, reduce damages to the workpiece during punching in the formation of the angled orifices.

16 Claims, 8 Drawing Sheets

FIG. 4B
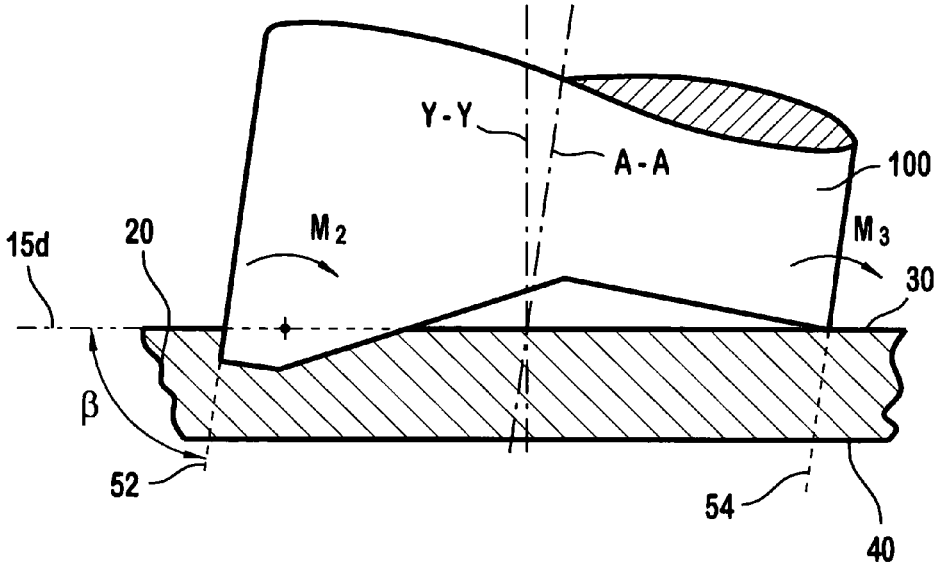
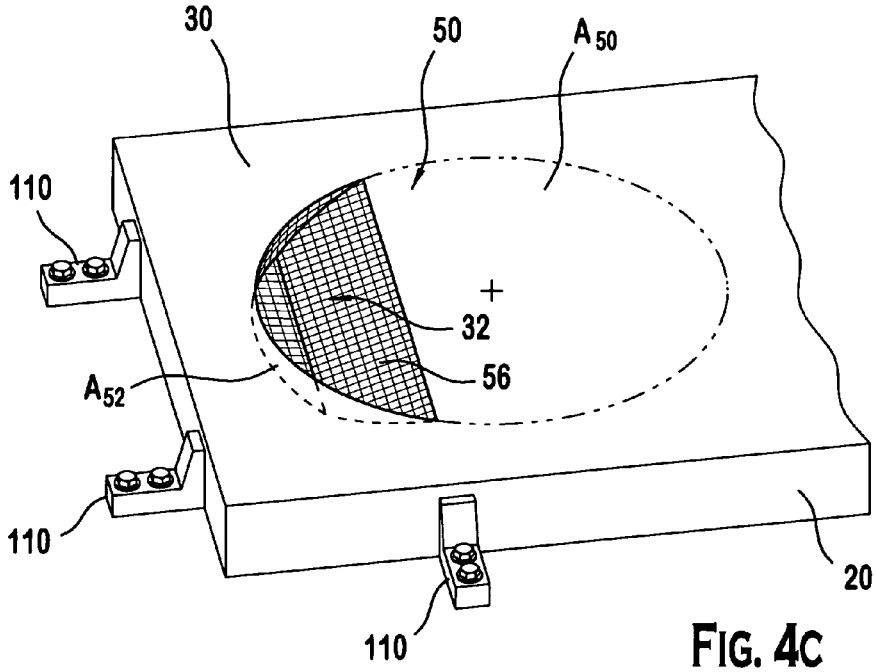
FIG. 4C

FIG. 4D
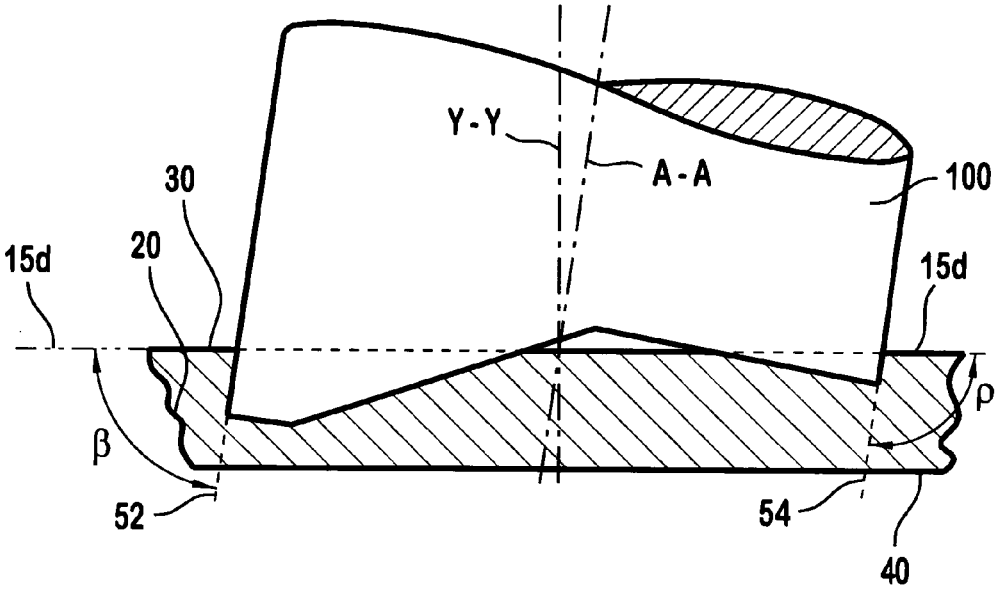
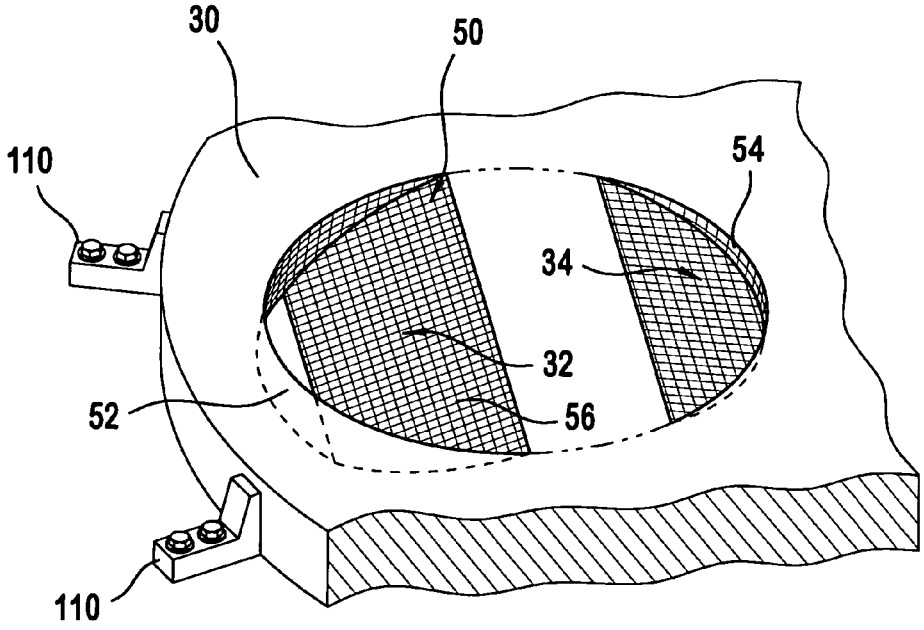
FIG. 4E

FIG. 4F
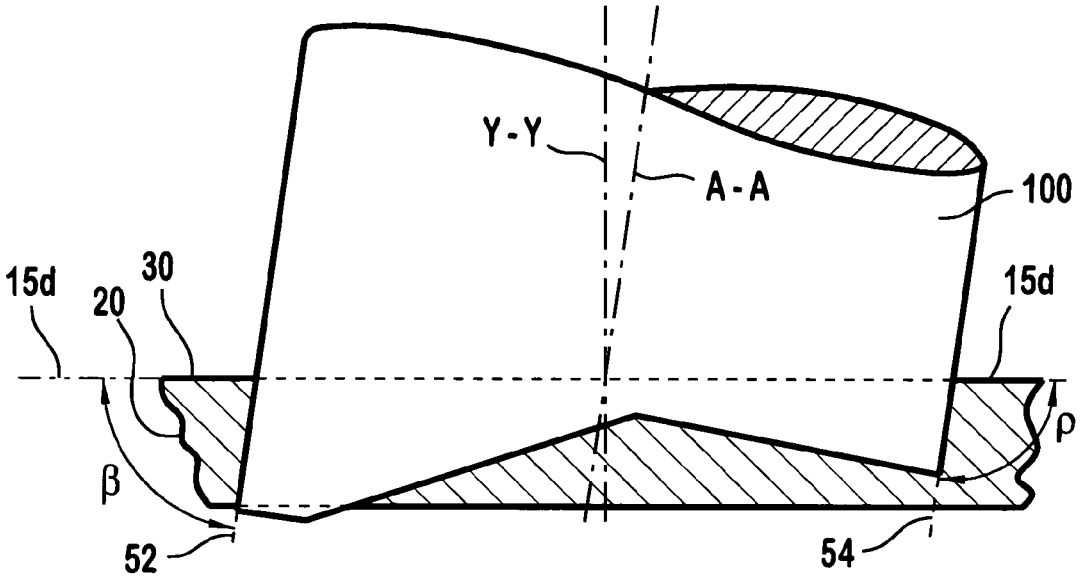
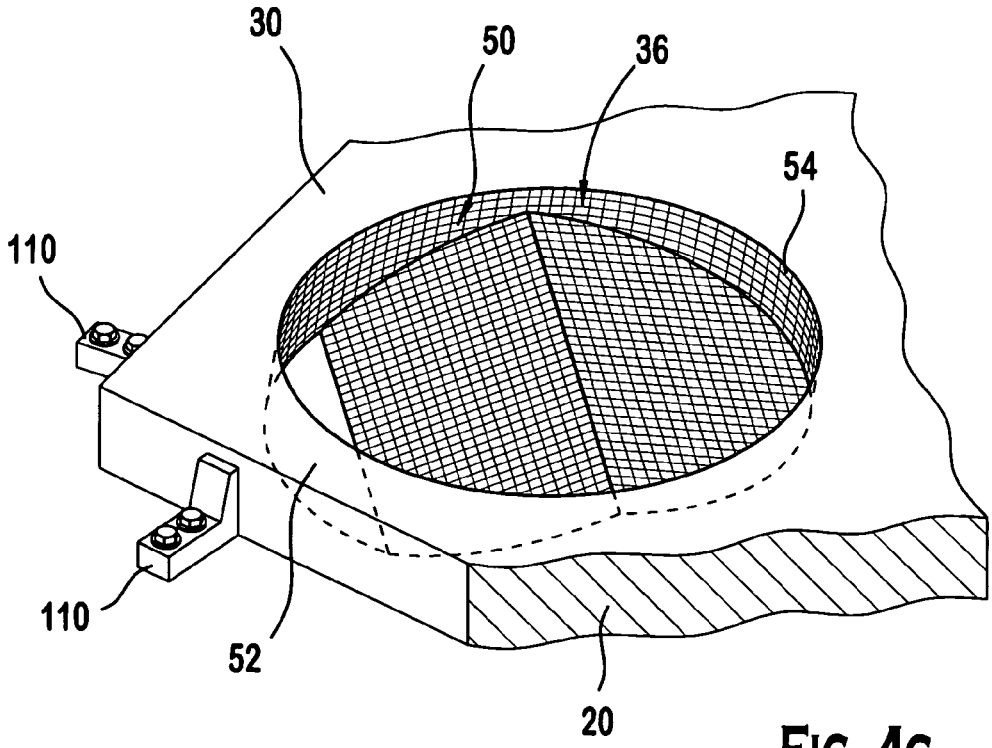
FIG. 4G

PUNCH TOOL FOR ANGLED ORIFICE

FIELD OF INVENTION

This invention relates generally to a punch tool that can be used to punch an orifice oriented at an angle less than 90 degrees with respect to a planar surface of a metering disc.

BACKGROUND OF THE INVENTION

It is believed that contemporary fuel injectors are designed to accommodate a particular engine. The ability to meet stringent tailpipe emission standards for mass-produced automotive vehicles is at least in part attributable to the ability to assure consistency in both shaping and aiming the injection spray or stream, e.g., toward an intake valve (or valves) or into a combustion cylinder. Wall wetting should be avoided.

Because of the large number of different engine models that use multi-point fuel injectors, a large number of unique injectors are needed to provide the desired shaping and aiming of the injection spray or stream for each cylinder of an engine. To accommodate these demands, fuel injectors have heretofore been designed to produce straight streams, bent streams, split streams, and split/bent streams. In fuel injectors utilizing thin disc orifice members, such injection patterns can be created solely by the specific design of the thin disc orifice member. This capability offers the opportunity for meaningful manufacturing economies since other components of the fuel injector are not necessarily required to have a unique design for a particular application, i.e. many other components can be of common design.

It is believed that known orifices can be formed in the following manner. A flat metering disc is formed with an orifice that extends generally perpendicular to the flat metering orifice disc, i.e., a "straight" orifice. In order to achieve a bending or split angle, i.e., an angle at which the orifice is oriented relative to a longitudinal axis of the fuel injector, the orifice can be formed by punching at an oblique angle relative to the longitudinal axis to provide an "angled orifice," i.e., an orifice angled with respect to the planar surface of the metering disc or a longitudinal axis extending perpendicularly between the flat surfaces of the disc.

It is believed that a known punch tool is formed of carbide and has a cylindrical body extending along a tool axis with a generally planar surface at a working end of the punch tool. The tool axis can be oriented at an angle oblique to the tool axis and a punching force can be applied to the punch along the tool axis so that the punch can penetrate through a blank workpiece. While the punch tool has acceptable performance during the punching of straight wall orifices, the punch tool has been observed to provide a less than desirable performance when the punch tool is used to form angled orifices. In particular, the generally planar surface at the working end of the tool tends to break during the punching process. Even if the punch tool does not break during the angled orifice punching process, the punch tool may skip, slide, or deflect upon impact with the surface of the workpiece and therefore could cause the workpiece to be damaged and discarded. Further, the skipping, sliding, or deflecting of the punch could cause the workpiece to move around laterally or vertically. To avoid the movements of the workpiece, a complex workpiece retention arrangement is utilized to ensure that the workpiece is stationary relative to a support surface.

Therefore, it would be desirable to provide for a punch tool that would have greater durability during the punching process for an angled orifice without resorting to complex or costly attempts in maintaining the same tool design or die design. Such attempts may include manufacturing the tool using exotic metals or an elaborate alignment and retention jig. It would also be desirable to provide for a punch tool that avoids skipping, sliding, or deflecting of the known punch tool during impact with a blank work strip.

SUMMARY OF THE INVENTION

The present invention relates to a novel punch tool with geometries that permit the punch tool to have greater durability in punching angled orifices. The geometries also prevent the punch tool from skipping, sliding, or deflecting during the punching process and therefore reduce the number of punch tools or workpieces that may be damaged during the punching process. The geometries also allow for a workpiece retention arrangement that reduces the total reliance upon a mechanism to clamp the workpiece. That is, the retention arrangement augments a known retention arrangement by preventing any lateral movements of the workpiece.

A preferred embodiment of the present invention includes a punch tool that can be used to form orifices oriented oblique to a longitudinal axis extending perpendicularly through the surfaces of a workpiece. The punch tool includes an elongated body and a penetrating end. The elongated body extends along a tool axis. The penetrating end is connected to the body and surrounds the tool axis. The penetrating end includes a pilot portion, a transition portion, and a main portion. The pilot portion has a first surface disposed on a first plane generally transverse to the tool axis. The first surface includes a first surface area offset to the tool axis. The main portion has a second surface area greater than the first surface area, which is offset to the tool axis. The second surface area is disposed on a second plane. The transition portion is disposed on a third plane generally oblique to the tool axis. The transition portion extends through the tool axis and connects the pilot portion and the main portion.

A preferred embodiment of the present invention provides for a method of forming an orifice through a disc. The orifice has an orifice area defining an opening that extends through the orifice disc along an orifice axis between first and a second generally planar surfaces spaced along a longitudinal axis of the disc. The orifice area being generally orthogonal to the longitudinal axis. The method can be achieved by preventing lateral movement of the disc relative to a support surface on which a portion of the second generally planar surface is disposed thereon; and displacing material over an area of approximately twenty five percent of the orifice area with a force sufficient to displace the material between the first and second generally planar surfaces so that the displaced material forms a first orifice wall surface extending between the first and second generally planar surfaces at an acute angle with respect to a virtual plane contiguous to the first generally planar surface.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

FIG. 4B illustrates a cross-sectional view of the pilot portion of the working end of the punch as it penetrates the surface of the workpiece.

FIG. 4C illustrates in an isometric view of the formation of the orifice in FIG. 4B without the preferred punch tool to show the particular characteristics of the orifice at the initial penetration stage of the punch.

FIG. 4D illustrates a cross-sectional view of the penetration of the workpiece by the pilot, transition, and part of the main portions of the preferred embodiment of the punch tool.

FIG. 4E illustrates the formation of the orifice in FIG. 4D in an isometric view without the punch tool in order to illustrate the particular characteristics of the orifice at this stage of the punching process.

FIG. 4F illustrates a cross-sectional view of the penetration of the workpiece by various portions of the working end of the preferred embodiment punch tool.

FIG. 4G illustrates the formation of the orifice in FIG. 4D in an isometric view without the punch tool in order to illustrate the particular characteristics of the orifice at this stage of the punching process.

DETAILED DESCRIPTION OF THE PREFERRED EMBODIMENT

Figure 1A:
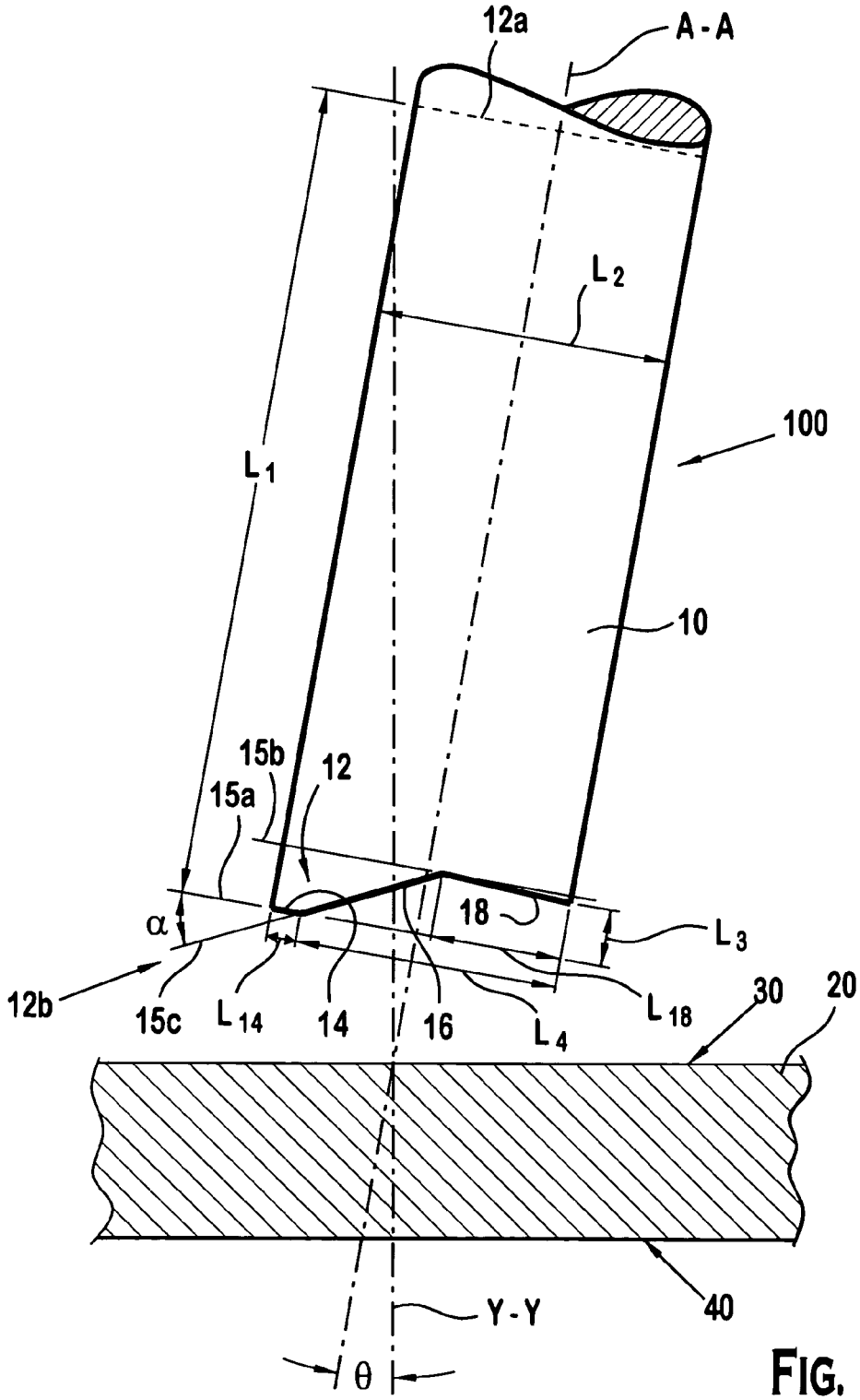
FIG. 1A is a cross-sectional view of a punch tool and a workpiece according to a preferred embodiment of the present invention.

FIGS. 1A–C, 2, and 4 illustrate the preferred embodiment. In particular, FIG. 1 depicts a punch tool 100 oriented at an angle θ with respect to a longitudinal axis Y—Y of a workpiece 20. The workpiece 20 has a first surface 30 and a second surface 40 that are preferably planar and parallel to each other and separated by a distance between 0.003 to 0.010 inches. In a preferred embodiment, the punch tool 100 can be formed from hardened tool steel and the punch tool 100 can be oriented at any one of an angle from three degrees to thirty degrees (3°–30°). Preferably, the workpiece 20 is a stainless steel blank strip (e.g., type 302, 304 or 430 series) with a thickness between the first and second surfaces 30, 40 of about 0.006 inches. Alternatively, the tool 100 can be formed with a treated steel material, i.e., coated or ion implanted steel material.

Figure 1B:
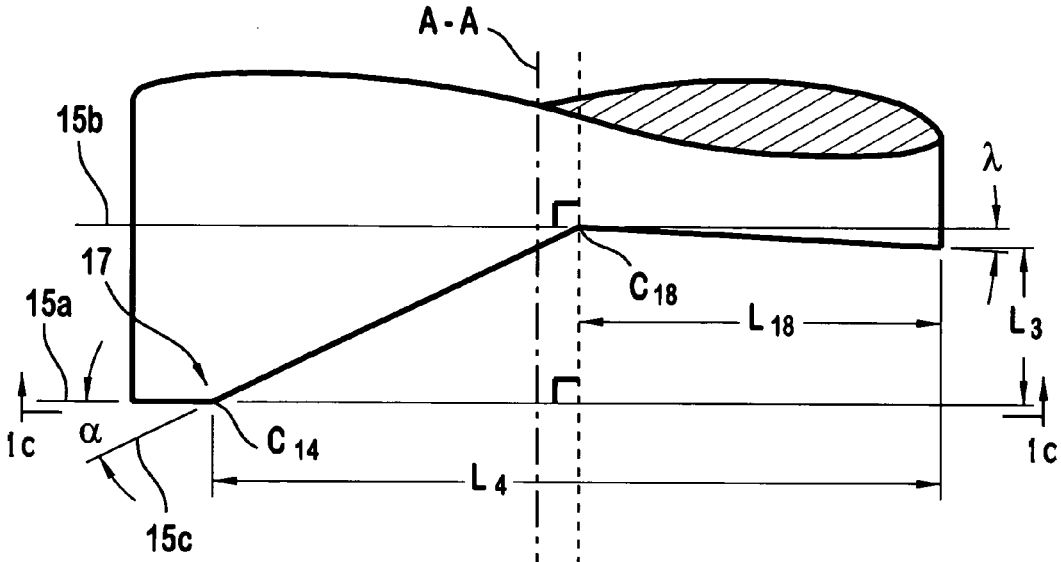
FIG. 1B is a close-up cross-sectional view of the punch tool of FIG. 1A.
Figure 1C:
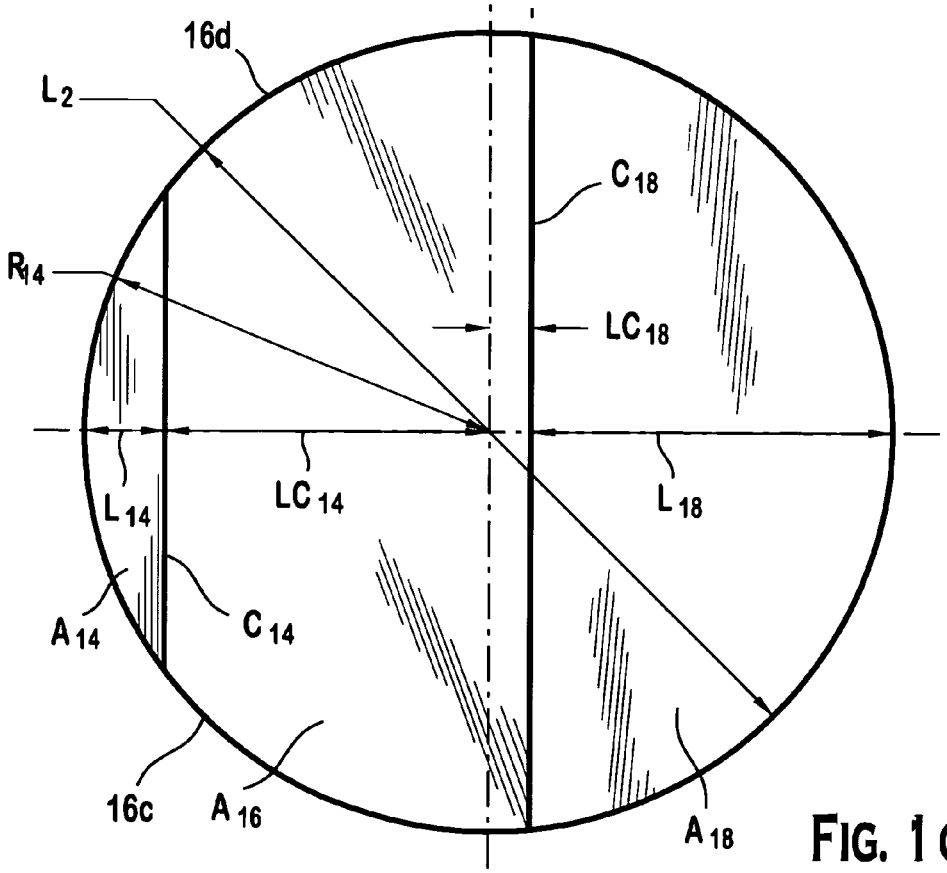
FIG. 1C is a planar view of the working end of the preferred embodiment of the punch tool of FIG. 1A.

Referring particularly to FIGS. 1A, 1B, 1C and 2, the punch tool 100 has a body portion 10 and a punching end 12. The body portion 10 can be an elongated member with a suitable cross-section, such as, for example, a circle, a rectangle, a square or an oval. The body portion 10 of the punch tool 100 can extend along the tool axis A—A over a distance $L_1$ between a first tool end 12*a* and a second tool end 12*b* (FIG. 1A). The body portion 10 preferably has a diameter $L_2$ of approximately 0.010 inches. Referring to FIGS. 1A and 1B, the second tool end 12*b* includes a pilot portion 14, a transition portion 16 and a main portion 18. Preferably, the elongated member has a circular section about a tool axis A—A (FIG. 1C). It is noted that in the following description, any reference to the dimensions should be understood to be the dimensions of the preferred embodiment with variations due to acceptable tolerances of these dimensions that will allow the preferred embodiment to function for its intended purpose in punching angled orifices and achieving specific orifice sizes or areas.

There are a number of design characteristics of the punch tool 100 that are believed to be advantageous in forming an angled orifice. Of particular emphasis are the pilot portion 14, transition portion 16 and main portion 18. The pilot portion 14 preferably has a semi-circular cross-sectional area disposed on a first virtual extension plane 15*a* and designate as a pilot area $A_{14}$ with a distance $L_{14}$. The main portion 18 is disposed on a second virtual extension plane 15*b* and preferably includes a semi-circular cross-section designated as a main area $A_{18}$ with a distance $L_{18}$. The transition portion 16 preferably includes curvilinear segments 16*c* and 16*d* of a truncated ellipse being disposed on a third virtual extension plane 15*c*.

The pilot portion 14 extends over a distance $L_3$ of about 0.020 inches from the outermost edge of the main portion 18. The distance $L_4$ between the pilot portion 14 and the farthest perimeter of the main portion 18 with respect to the pilot portion 14 is about 0.009 inches. The radius $R_{14}$ of the punch tool is about 0.005 inches with a chord $C_{14}$ located at about 0.0039 inches from the tool axis A—A when the chord $C_{14}$ is projected to a first virtual plane 15*a* contiguous to the surface area $A_{14}$, as seen in FIG. 1C. A distance between chord $C_{18}$ of the main portion 18 to the geometric center of the punch tool 100 is about 0.0006 inches when the chord $C_{18}$ and the center are projected onto second virtual plane 15*b*, as seen in FIG. 1C; a cut-back angle λ of the main portion 18 is about 3 degrees with respect to the second virtual plane 15*b*.

The pilot portion 14 preferably has a pilot surface area $A_{14}$ offset and generally orthogonal to the tool axis A—A of approximately $1.88\times10^{-5}$ square inches. As used herein, the term "offset" denotes that portions of the tool described herein do not intersect the tool axis A-A. Preferably, the main portion 18 is offset to the tool axis A—A with a main surface area $A_{18}$ of approximately $3.36\times10^{-5}$ square inches or about 1.8 times the pilot area $A_{14}$.

Figure 2:
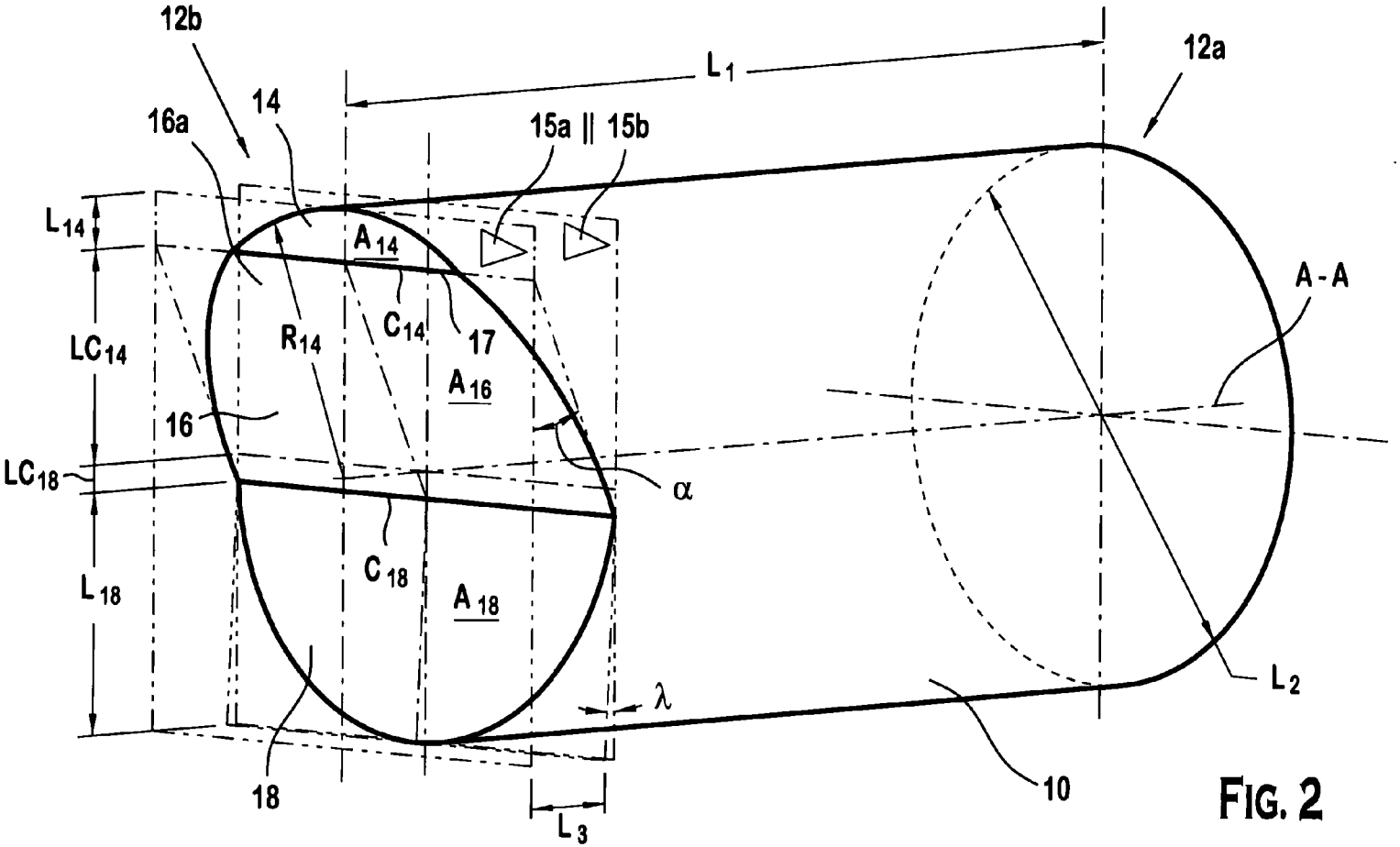
FIG. 2 is an isometric view of the working end of the punch tool of FIG. 1A.

The surface area $A_{16}$ of the transition portion 16 is disposed on the third plane 15*c* extends from the pilot portion 14 to the main portion 18 at a transition angle α of between 20 to 30 degrees as referenced to the first virtual extension plane 15*a* of the penetrating surface $A_{14}$ (FIGS. 1C and 2). Preferably, the transition portion 16 extends through the tool axis A—A with the transition angle α of about twenty-six (26°) degrees as referenced to the first virtual extension plane 15*a*.

The design characteristics of the punch tool 100 are believed to be advantageous in forming angled orifices. In particular, because the pilot portion 14 is connected to the main portion 18 with the transition portion 16 at about 26 degrees, a juncture 17 formed by an intersection of the pilot area $A_{14}$ and the transition area $A_{16}$ to allow the juncture 17 to initially contact the surface of the workpiece 20. It is believed that this design characteristic of the tool 100 reduces the moment being applied to the punch tool 100, which is believed to be the cause of tool breakage during the punching process as discovered by applicant. By reducing this moment, it is believed that the tendency of the tool to skip or deflect during the punching process is reduced. Furthermore, because the surface area $A_{14}$ of the pilot portion is approximately sixty percent of the main area $A_{18}$, the pilot portion 14 can apply a higher penetrating pressure to the workpiece 20. It is believed that this design characteristic permits the punch tool 100 to be guided deeper into the surface of the workpiece 20 upon impact prior to an actual shearing of the material of the workpiece 20. That is, by providing a pilot area of approximately sixty-percent to that of the main area, the punching force Fp is concentrated over a smaller area on the workpiece 20, thereby allowing the pilot portion 14 to securely penetrate into the workpiece 20.

Empirical evaluation has shown that the punch tool 100 reduces the rate of failure by ten times as compared to the known punch tool 200. As used herein, the term "failure" denotes damage either to the blank workpiece or to the punch tool such that either one may not suitable for use as a metering orifice disc or a punch tool.

Figure 3:
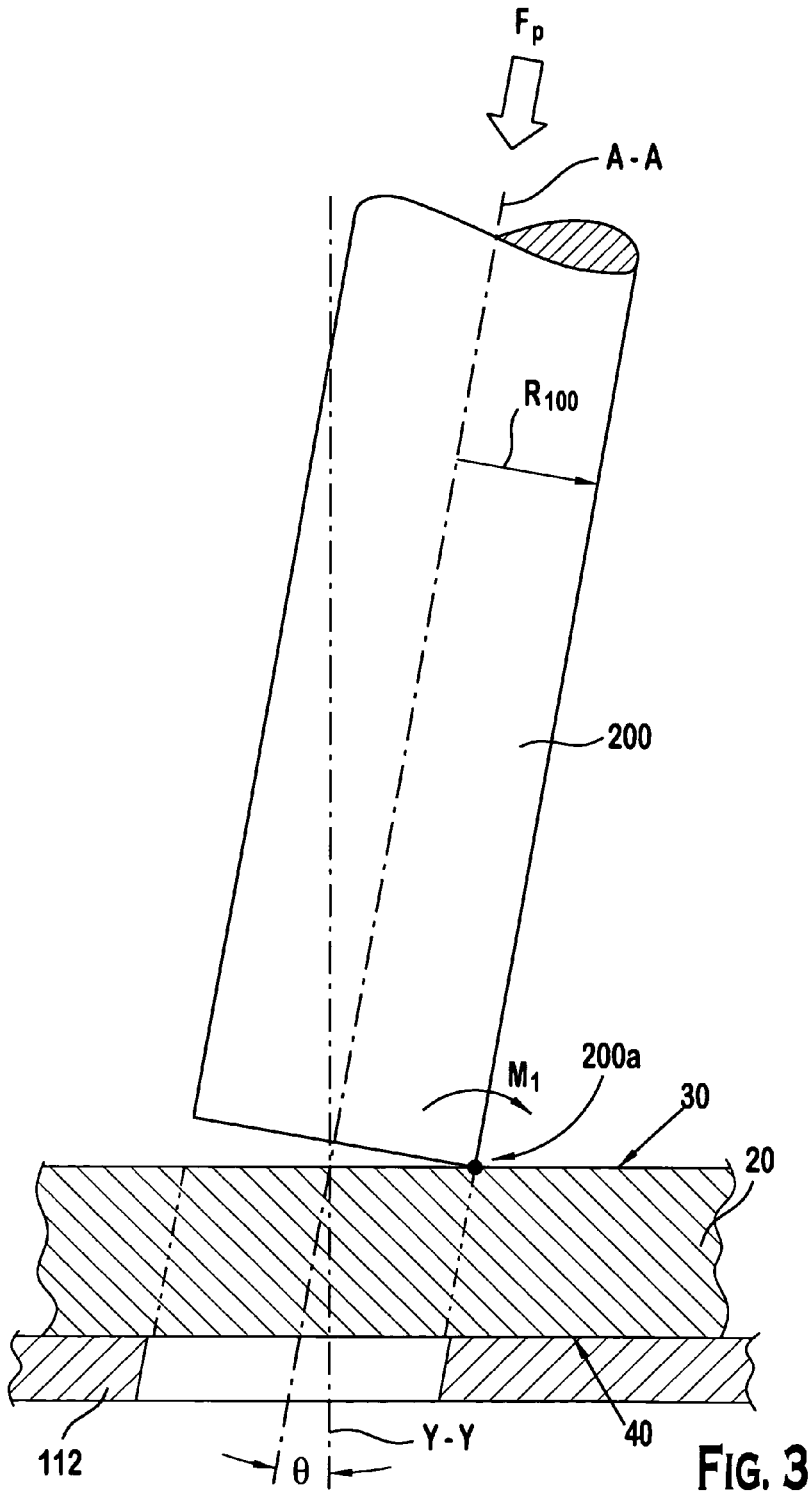
FIG. 3 is a cross-sectional view of a known punch tool and workpiece at a position prior to impact of the tool on the workpiece.
Figure 4A:
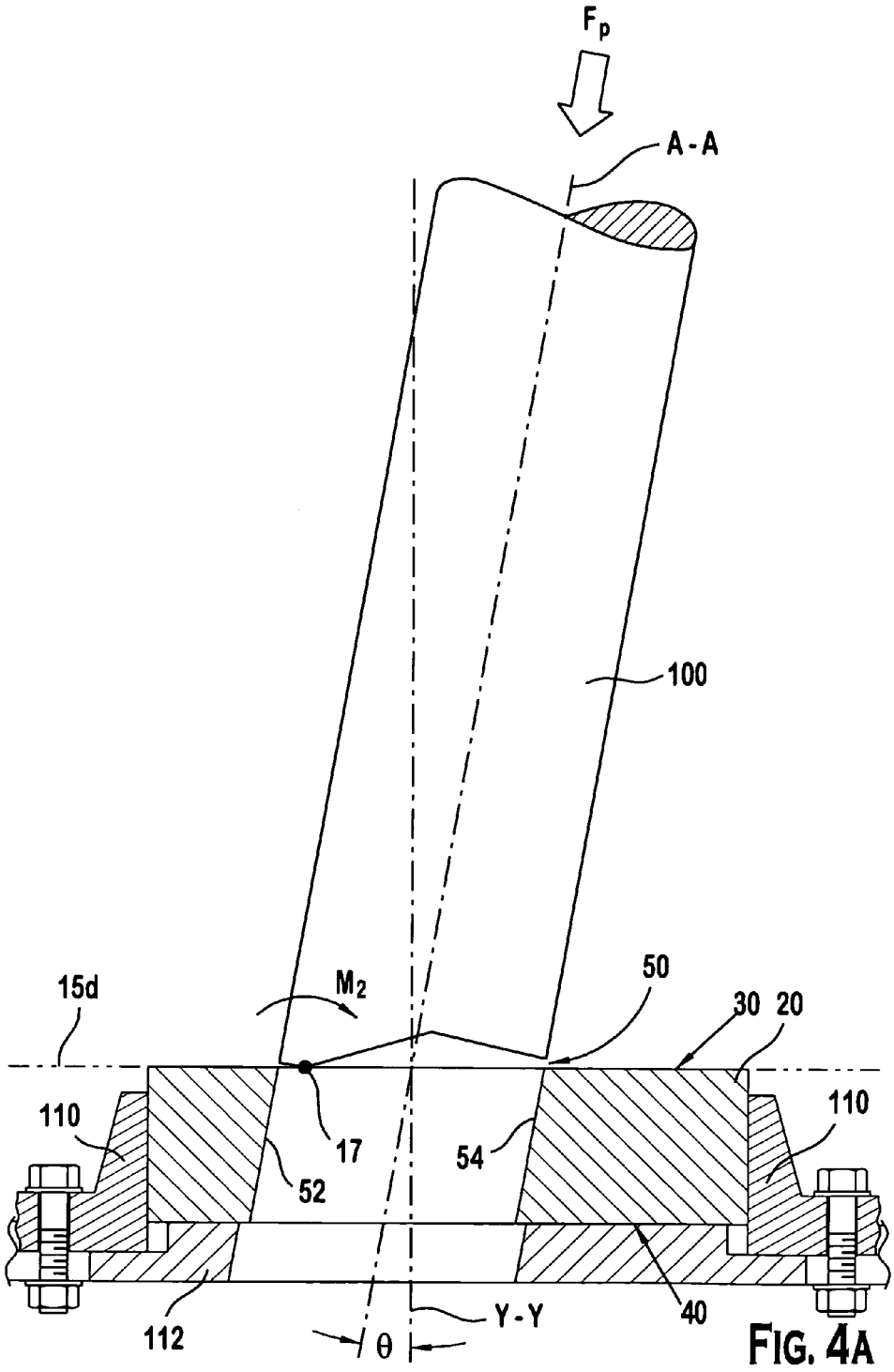
FIG. 4A is a cross-sectional view of the punch tool of the preferred embodiment prior to impact of the novel punch tool on the workpiece.

FIGS. 3 and 4A–4G are provided to graphically demonstrate the benefits of these design characteristics of the preferred embodiment of the punch tool 100. In particular, FIG. 4A illustrates that the preferred embodiment can reduce a moment or side loading as the punch tool 100 is being used to penetrate through the workpiece 20. In FIG. 3, the known punch tool 200 is depicted as being applied with a force Fp through a tool axis A—A of the known tool 200. The known tool 200 is also depicted at a position where an edge portion 200*a* is contiguous with the surface 30 of the workpiece 20. At this edge portion 200*a*, a pivoting edge can be formed by the known punch tool 200 that tends to rotate the tool 200 with a clockwise moment arm $M_1$, which is approximately equal to the force Fp acting through a radius of $R_{100}$. In contrast, as depicted in FIG. 4A, the juncture 17 of the punch tool 100 of the preferred embodiment permits a smaller clockwise moment arm $M_2$ to be generated about a pivoting edge formed between the juncture 17 and the surface 30 of the workpiece. Thus, the smaller clockwise moment arm $M_2$ of the preferred embodiment tends to reduce side loading, deflection or skipping of the punch tool—as compared to the clockwise and larger moment arm $M_1$ of the known punch tool 200.

Moreover, the ratio of surface area of the pilot portion 14 as compared to the main portion 18 is believed to be advantageous because the punching force Fp is delivered over a smaller surface area of the pilot portion, thereby allowing the punch tool 100 to penetrate deeper into the surface 20 before a substantial amount of material removal takes place via the main portion 18 (FIG. 4C). As the punch tool 100 penetrates deeper into the material of the workpiece 20, the cut-back angle $\lambda$ of the main portion 18 is believed to permit the punch tool 100 to be further secured to the workpiece, thereby reducing the propensity of the tool to skip or slide despite the presence of a third clockwise movement $M_3$ (FIG. 4B) generated by the main portion 18.

In order for the punch tool 100 to penetrate the surface 30 of the workpiece 20 to form the angled orifice 50, the workpiece 20 must remain stationary via a preferred retention arrangement. To illustrate the advantages of the preferred retention arrangement, however, it is necessary to provide a brief description of the known arrangement as follows.

In the known punch tool and retention arrangement, it has been observed that the workpiece has a propensity to move vertically or laterally with respect to the longitudinal axis Y—Y upon the penetration of the known punch tool 200. To prevent such movement, the known retention arrangement is designed to apply a clamping or spring force, e.g., via a clamping or, as known in the art, a stripper plate (not shown for clarity and as is known by those of ordinary skill in the art) to the top surface of the workpiece along the longitudinal axis Y—Y against a support surface 112. By virtue of the vertical clamping force, the workpiece is prevented from moving vertically along the longitudinal axis Y—Y away from the support surface 112. And by virtue of the vertical clamping force and coefficient of friction of the bottom surface 40 of the workpiece relative to the support surface 112 (FIG. 4A), the workpiece 20 is prevented from moving laterally with respect to the longitudinal axis Y—Y in the known retention arrangement. The known retention arrangement prevents lateral and vertical movement. However, the known arrangement is insufficient because it permits slight lateral movements.

In contrast to the known retention arrangement, the preferred workpiece retention arrangement is not dependent on a clamping force of the stripper plate because the preferred retention arrangement augments the stripper plate so that there is generally no lateral movement. As illustrated pictorially in FIG. 4A, two or more stop members 110 abutting against the side surfaces of the workpiece 20 can be used to prevent lateral movement of the workpiece 20 without the necessity of excessively clamping the workpiece 20 towards the support surface 112. The use of the preferred arrangement, which is beyond the known design, is believed to be advantageous in reducing the damage to the workpiece and tool. The advantages of the preferred retention arrangement and tool design are believed to be due to the ability of the punch tool 100 to penetrate the surface 30 of the workpiece in a single operation without the tool 100 or workpiece 20 sliding, skipping or otherwise causing the workpiece 20 to bounce or move away upon impact of tool 100. Because of this ability of the punch tool to secure and guide the tool deeper into the surface of the workpiece, arrangements other than the preferred stop-member arrangement can also be utilized. For example, spikes can be formed on the support surface 112 that engage the bottom surface 40 of the workpiece, or a separate holder arrangement with spikes that engage the top surface 30 of workpiece 20 can be used to prevent lateral movement of the workpiece 20 when the angled orifice 50 is being formed. The stop members can include a generally planar support surface connected to two wall surfaces extending generally parallel to the longitudinal axis Y—Y to form a workpiece holder, which wall surfaces can define a circular or polygonal perimeter to constrain the workpiece from lateral movements. Preferably, the workpiece is a blank strip of material having a length longer than its width with at least two lateral sides extending generally parallel to each other so that stop members can engage the respective lateral sides. In the preferred embodiment, the stop members are arranged on the lateral sides extending generally parallel to the longitudinal axis Y—Y.

Throughout the punching process of the angled orifice 50, several characteristics of an angled orifice 50 can be seen in FIGS. 4A–4G. Referring to FIG. 4A, the angled orifice 50 is depicted with wall surfaces 52 and 54 extending between the generally planar surfaces 30 and 40. The surface area $A_{50}$ of the orifice 50 can be generally equal to the cross-sectional area of the body 10 (in FIG. 1A) of the punch tool 100, which is preferably $7.85\times10^{-4}$ square inches. When the pilot portion of the punch tool 100 has penetrated the first surface 30, a first surface characteristic of the orifice 50 can be observed in FIG. 4C (shown without the punch tool for clarity). The surface on which material is displaced (e.g., compressed or plastically yielded) from the first surface 30 has a first surface area $A_{52}$ of about ¼ of the orifice surface area $A_{50}$. A wall 52 can be formed so that when measured with a virtual plane 15*d* contiguous to the surface 30, an acute angle β can be formed (FIG. 4B). The orifice at this stage has a first impression defined by wall surfaces 52, the first surface area $A_{52}$ connected to a transition surface 56 that is connected to the first generally planar surface 30.

As the punch tool 100 is further extended into the material of the workpiece 20 as depicted in FIG. 4D, the surface area on which the punching force Fp is being distributed is increased in a generally linear manner between the initial penetration to partial penetration of the surface 30 due to the presence of the transition portion 16. At this point, another surface characteristic of the orifice 50 can be observed in an isometric view of FIG. 4E (shown without the punch tool for clarity). A second impression in the surface 30 is now formed in addition to the first impression. The second impression has wall surface 54 extending at an obtuse angle ρ relative to a fourth virtual plane 15*d*. Thus, two spaced apart impressions or voids 32 and 34 are formed in sequence during the process of stamping the orifice 50.

As the punch tool 100 is yet further extended into the material of the workpiece 20, the first and second impressions now become a single continuous impression. Finally, as the punch tool 100 is extended entirely through the second surface 40, this single continuous impression becomes the angled orifice 50 with a continuous wall surface depicted in a cross sectional view of FIG. 4F as walls 52 and 54.

Thus, the preferred punch tool, retention arrangement, and method are believed to be advantageous because the service life of the punch tool is significantly longer as compared to known punch tools and clamping arrangements. Consequently, the punching operation utilizing the preferred embodiments of the punch tool and retention arrangement can be more efficient.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

We claim:

1. A tool for punching a metering orifice extending at an acute angle through a fuel metering disc of a fuel injector along an orifice axis with respect to at least one planar surface of the metering disc, the metering orifice extending between first and second generally planar surfaces spaced along a longitudinal axis of the disc, the tool comprising:

an elongated body extending along a tool axis between a first tool end and second tool end about a tool axis to define a tool perimeter, the first tool end configured to receive a tool punching force, the second end including:

a pilot portion having a first surface disposed on a first plane generally transverse to the tool axis, the first surface including a first surface area offset to the tool axis, the first surface area of the pilot portion including an area bounded by a first arcuate portion of the perimeter of the second tool end and a first chord connecting the first arcuate portion;

a main portion having a second surface area greater than the first surface area offset to the tool axis, the second surface area disposed on a second plane wherein the second surface area of the main portion comprises an area bounded by a second arcuate portion of the perimeter of the second tool end and a second chord connecting the second arcuate portion; and a transition portion disposed on a third plane generally oblique to the tool axis, the transition portion intersecting the longitudinal axis and connecting the pilot portion and the main portion.

2. The tool according to claim 1, wherein the second surface area comprises an area disposed on the second plane oblique to the tool axis.

3. The tool according to claim 2, wherein the second surface area comprises an area approximately 1.8 times the first surface area.

4. The tool according to claim 2, wherein the elongated body of the tool comprises one of a tool steel material and treated steel material.

5. The tool according to claim 2, wherein the pilot portion has a surface area bounded by a pilot segment contiguous to the tool perimeter and a first chord connecting the pilot segment, the first chord being spaced from the tool axis at a distance of about 0.0039 inches.

6. The tool according to claim 5, wherein the main portion has a surface area bounded by a segment contiguous to the tool perimeter and a chord connecting the segment, the chord being spaced at a distance of about 0.0006 inches from the tool axis.

7. A tool for punching a metering orifice extending at an acute angle through a fuel metering disc of a fuel injector along an orifice axis with respect to at least one planar surface of the metering disc, the metering orifice extending between first and second generally planar surfaces spaced along a longitudinal axis of the disc, the tool comprising:

an elongated body extending along a tool axis between a first tool end and a second tool end about a tool axis to define a tool perimeter, the first tool end configured to receive a tool punching force, the second end including:

a pilot portion having a first surface disposed on a first plane generally transverse to the tool axis, the first surface including a first surface area offset to the tool axis, the first surface area of the pilot portion includes an area bounded by a first arcuate portion of the perimeter of the second tool end and a first chord connecting the first arcuate portion;

a main portion having a second surface area greater than the first surface area offset to the tool axis, the second surface area disposed on a second plane; and a transition portion disposed on a third plane generally oblique to the tool axis, the transition portion intersecting the longitudinal axis and connecting the pilot portion and the main portion.

8. The tool according to claim 7, wherein the second surface area of the main portion comprises an area bounded by a second arcuate portion of the perimeter of the second tool end and a second chord connecting the second arcuate portion.

9. The tool according to claim 8, wherein the transition portion comprises two arcuate transition segments, each transition segment connecting the first and second chords at the respective ends.

10. The tool according to claim 9, wherein the second end comprises a generally circular perimeter about the tool axis such that the first and second arcuate portions and the transition segments are coincident with the generally circular perimeter.

11. The tool according to claim 10, wherein the generally circular perimeter comprises a circular area having a diameter extending through the tool axis of approximately 0.01 inches.

12. The tool according to claim 11, wherein transition portion comprises a generally planar surface disposed at a first transition angle with respect to the first virtual plane.

13. The tool according to claim 12, wherein the main portion comprises a generally planar surface area disposed at a second transition angle with respect to the first virtual plane of approximately 10 percent of the first transition angle.

14. The tool according to claim 13, wherein the first transition angle is approximately 26 degrees.

15. The tool according to claim 14, wherein a first virtual line bisecting the first surface area has a magnitude of approximately 0.001 inches and a second virtual line bisecting the second surface area has a magnitude of approximately 0.004 inches.

16. An arrangement for forming orifices in a workpiece, the arrangement comprising:

a workpiece having a first surface spaced from a second surface along a longitudinal axis, the workpiece having a length longer than its width, the workpiece including respective lateral sides extending generally parallel to each other;

a workpiece retention device having at least two stop members positively engaging the respective lateral sides of the workpiece; and a tool including:

an elongated body extending along a tool axis between a first tool end and a second tool end about a tool axis to define a tool perimeter, the first tool end configured to receive a tool punching force, the second end including:

a pilot portion having a first surface disposed: on a first plane generally transverse to the tool axis, the first surface including a first surface area offset to the tool axis, the first surface area of the pilot portion including an area bounded by a first arcuate portion of the perimeter of the second tool end and a first chord connecting the first arcuate portion;

a main portion having a second surface area greater than the first surface area offset to the tool axis, the second surface area disposed on a second plane, wherein the second surface area of the main portion comprises an area bounded by a second arcuate portion of the perimeter of the second tool end and a second chord connecting the second arcuate portion; and a transition portion disposed on a third plane generally oblique to the tool axis, the transition portion extending through the longitudinal axis and connecting the pilot portion and the main portion.

* * * * *